US010594016B2

(12) United States Patent
Sarkis et al.

(10) Patent No.: US 10,594,016 B2
(45) Date of Patent: Mar. 17, 2020

(54) TWO BIDIMENSIONAL MULTIBAND ANTENNA AND A GLAZING PANEL WITH THE ANTENNA PRINTED THEREON

(71) Applicant: AGC GLASS EUROPE, Louvain-la-Neuve (BE)

(72) Inventors: Remi Sarkis, Louvain-la-Neuve (BE); Dan Lis, Isnes (BE)

(73) Assignee: AGC GLASS EUROPE, Louvain-la-Neuve (BE)

( * ) Notice: Subject to any disclaimer, the term of this patent is extended or adjusted under 35 U.S.C. 154(b) by 0 days.

(21) Appl. No.: 15/778,668

(22) PCT Filed: Nov. 24, 2016

(86) PCT No.: PCT/EP2016/078616
§ 371 (c)(1),
(2) Date: May 24, 2018

(87) PCT Pub. No.: WO2017/089435
PCT Pub. Date: Jun. 1, 2017

(65) Prior Publication Data

US 2018/0351231 A1 Dec. 6, 2018

(30) Foreign Application Priority Data

Nov. 27, 2015 (EP) ..... 15196656

(51) Int. Cl.
*H01Q 1/32* (2006.01)
*H01Q 1/12* (2006.01)
*H01Q 5/371* (2015.01)

(52) U.S. Cl.
CPC ..... *H01Q 1/1271* (2013.01); *H01Q 1/325* (2013.01); *H01Q 5/371* (2015.01)

(58) Field of Classification Search
CPC .. H01Q 1/1271; H01Q 1/3275; H01Q 1/1278; H01Q 1/1207; H01Q 1/12; H01Q 1/125; H01Q 1/273; H01Q 7/00
(Continued)

(56) References Cited

U.S. PATENT DOCUMENTS

2011/0273338 A1 11/2011 Wolf
2015/0349411 A1* 12/2015 Kagaya ..... H01Q 1/1271 343/713

(Continued)

FOREIGN PATENT DOCUMENTS

CN 201383547 Y 1/2010
EP 1 793 449 A1 6/2007
WO WO 2015/158361 A1 10/2015

OTHER PUBLICATIONS

International Search Report dated Feb. 16, 2017 in PCT/EP2016/078616 filed Nov. 24, 2016.

*Primary Examiner* — Binh B Tran
*Assistant Examiner* — Collin Dawkins
(74) *Attorney, Agent, or Firm* — Oblon, McClelland, Maier & Neustadt, L.L.P.

(57) ABSTRACT

The present invention concerns a two bidimensional part multiband antenna arranged to be printed on a glazing panel, the two parts to be connected, respectively, to a central pin and a shield of a data transmission coaxial cable. The two parts have a generally rectangular shape and are relatively to each other longitudinally shifted, the two respective sides of the two parts adjacent to each other comprise respectively a large transversal recess and a corresponding transversal projection facing each other. The part comprising the projection comprises, adjacent thereto, a thin longitudinal arm facing a short transversal finger of the part comprising the recess and adjacent thereto.

19 Claims, 1 Drawing Sheet

Figure 1:
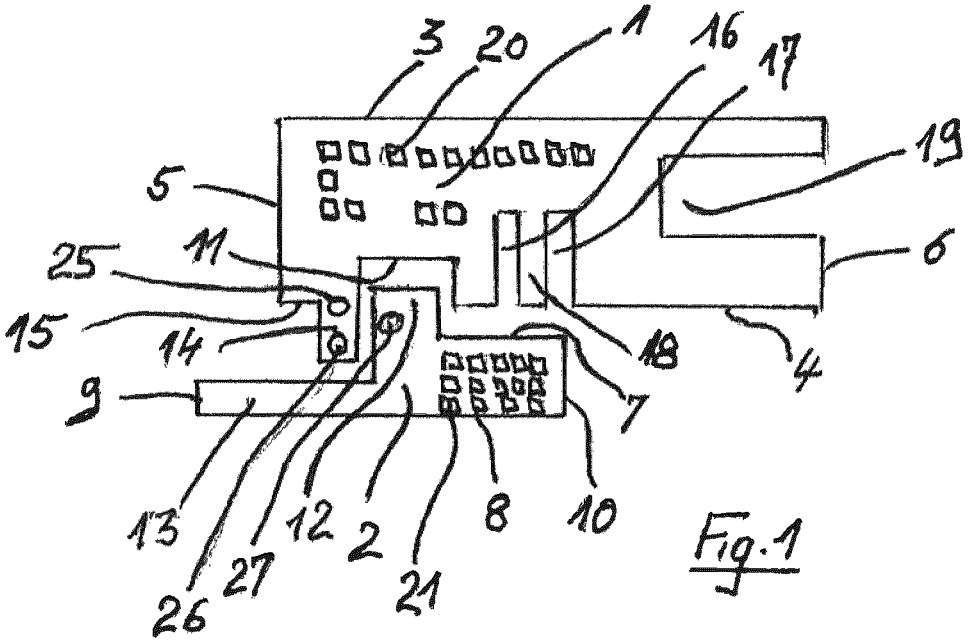

(58) Field of Classification Search
USPC ..... 343/713, 718, 720, 878
See application file for complete search history.

(56) References Cited

U.S. PATENT DOCUMENTS

| | | | | |
|---|---|---|---|---|
| 2017/0033433 | A1 | 2/2017 | Winkelmann et al. | |
| 2018/0151939 | A1* | 5/2018 | Hashimoto | B60J 1/00 |

* cited by examiner

TWO BIDIMENSIONAL MULTIBAND ANTENNA AND A GLAZING PANEL WITH THE ANTENNA PRINTED THEREON

The present invention relates to buildings or vehicles, which comprise glazing panels with an antenna printed thereon for radio communication with receivers or transmitters outside or associated with these buildings or vehicles, by means of personal cellular radio terminals. These antennas are components of all kinds of equipment using radio waves, such as radio broadcasting systems, broadcast television systems, radars, cell phone terminals, satellite communication systems and other garage or car door openers, wireless microphones, Bluetooth-enabled devices, wireless computer networks or RFID tags on merchandise.

The present invention relates more particularly to high frequency (HF) and wide band (WB) communication. Unlike low frequency communication which can make use of wire antennas, like the heating wires printed on the back lite of cars, connected to standard data transmission lines, HF and WB communication requires two bidimensional part antennas with data transmission coaxial cables. With bidimensional part, it is meant a part which is not linear (threadlike?), which is not a wire, but which has a certain surface.

The antennas here of concern are mainly provided as long term evolution (LTE) antennas, namely for mobile internet and 4G cellular telephone networks.

The two parts of these antennas are connected to the central pin and to the shield of the coaxial cables, respectively.

The two parts of these antennas can be made of an alloy of silver or copper to be printed on glass or plastics.

The object of the present invention is to provide an antenna of the above type which is a multiband antenna.

To this end, the invention relates to a two bidimensional part multiband antenna arranged to be printed on a glazing panel, the two parts to be connected, respectively, to a central pin and a shield of a data transmission coaxial cable, characterized in that:

- the two parts have a generally rectangular shape and are relatively to each other longitudinally shifted, the two respective sides of the two parts adjacent to each other comprise respectively a large transversal recess and a corresponding transversal projection facing each other and
- the part comprising the projection comprises, adjacent thereto, a thin longitudinal arm facing a short transversal finger of the part comprising the recess and adjacent thereto.

It is after a quite long trial-and-error process that the applicant succeeded in defining the above claimed antenna. This process has really not been straight forward and it should be recognized that the above features of the claimed antenna are interrelated in a complex manner which cannot be easily explained. The inventiveness of the invention, which is not the simple result of the invention of standard technical skills, should be admitted.

Advantageously, the part of the antenna provided with the recess and its adjacent transversal finger, comprises, on the other side of the large recess and along the longitudinal side of said part facing the other part with the projection, two transversal and narrow recesses on both sides of a narrow tooth.

Preferably, the part of the antenna, provided with the transversal finger, comprises, on the transversal side opposite thereto, a large longitudinal recess.

More preferably, the two parts of the antenna comprise holes for saving material without altering the electrical function of the antenna.

The invention also relates to a glazing panel comprising a transparent sheet with the above two bidimensional part multiband antenna printed thereon by serigraphy.

Advantageously, the transparent sheet is made of glass or plastics material.

Preferably, the transparent sheet is a glazing panel which can be flat or curved to fit with the design of the car or the building wherein the glazing panel will be integrated. The glazing panel can be tempered to respect with the specifications of security. When a glazing panel according to the invention is integrated into a car or a vehicle in general, a heatable system, for example a coating or a network of wires, can be applied on the pane of glass to add a defrosting function for example. Also, the glazing panel can be a clear glass or a colored glass, tinted with a specific composition of the glass or by applying a coating or a plastic layer for example.

According to one preferred embodiment of the present invention, the glazing panel is a glazing for automotive, i.e. windshield, backlite, sidelite or fixed in the carbody, such as roof.

Figure 2:
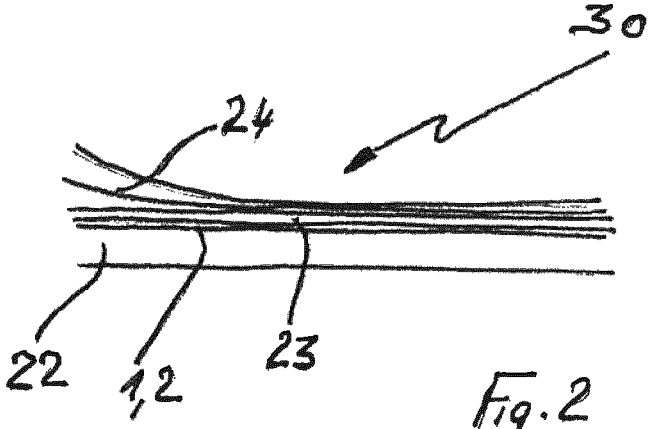

The invention shall be better understood upon reading the following description with the help of the attached drawing, where:

FIG. 1 is a top view of the two bidimensional part multiband antenna of the invention and FIG. 2 is a cross-sectional view illustrating the process for making the glazing panel of the invention.

The antenna of the invention as shown on FIG. 1 includes two bidimensional parts 1 and 2. The antenna is arranged for being connected to a data transmission coaxial cable, not shown, part 1 to the shield of the cable, part 2, to the central pin of the cable, in a way to be later on better explained.

The two parts 1 and 2 are generally rectangular in shape. Part 1 has two longitudinal sides 3, 4 and two transversal sides 5, 6. Part 2 has two longitudinal sides 7, 8 and two transversal sides 9, 10. The two parts 1, 2 are relatively to each other longitudinally shifted. In other words, beyond the fact that the surface of part 2 is smaller than the surface of part 1, looking at FIG. 1, transversal sides 9, 10 of part 2 are shifted to the left with respect to transversal sides 5, 6 of part 1.

Longitudinal side 4 of part 1 facing part 2 is provided with a large and rectangular transversal recess 11. Longitudinal side 7 of part 2, adjacent to longitudinal side 4 of part 1 is provided, in front of recess 11 of part 1, with a rectangular projection 12 thus facing recess 11.

Part 2, to be connected to the central pin and which comprises projection 12, comprises, adjacent to the projection, a thin longitudinal arm 13 extending between transversal side 9 and projection 12.

This arm 13 is facing a short transversal finger 14 of part 1, adjacent recess 11 and forming a shoulder 15 with transversal side 5 of part 1.

Part 1 of the antenna comprises, on the other side of the large recess 11 and along the longitudinal side 4 facing part 2, two transversal, deep and narrow recesses 16, 17, with a narrow tooth 18 in between.

Part 1, on the other side 6 opposite finger 14, comprises a large, deep and longitudinal recess 19.

The two parts 1, 2 of the antenna are made of an alloy of silver of copper, with a large amount of one of the two metals, roughly and for instance 95%. However, the two parts of these antennas may be made in any conductive material suitable for this invention. Within the scope of the invention, by "conductive" material it is meant a material that is substantially conductive with a resistivity of less than 10 ohm/squared, preferably less than 5 ohm/squared.

For saving the alloy, but without altering the electrical function of the antenna, the two parts 1, 2 of the antenna comprise holes 20, 21, respectively.

The antenna 1, 2, as described above, is printed onto a sheet of glass or plastics 22 to form a glazing panel 30. It is printed for example by a standard serigraphy process, by means of a mask 23, made of plastics, the liquid alloy 24 being poored on top of the mask 23 and flowing through its holes to form the antenna (FIG. 2).

The antenna should be connected to a data transmission coaxial cable comprising a central pin surrounded by a shield. The shield could be connected by a connecting bridge welded at two points 25, 26 of the transversal finger 14 of part 1 of the antenna. The central pin of the cable could be connected at point 27 of the projection 12 of part 2 of the antenna.

According to one embodiment of the present invention, the coaxial cable is a cable designed to allow carrying higher frequency signals better than a cable used for automotive antenna placed on glass and comprises at least a pin and a shield separated by a dielectric element and protected by an insulated layer.

According to one preferred embodiment of the present invention, the electrically conductive connector connects an antenna to the cable and is joined to the antenna by a lead-free soldering to respect the new European regulation.

The electrically conductive connector material is preferably a material selected to have difference of thermal expansion of the glazing panel and the electrically conductive connector material less than 5×10−6/° C.

According to the invention, the connector may be made of different types of material such as Copper, Chromium alloys, Steel alloys such stainless steel alloys, steel alloys with a high amount of Chromium or Nickel or any other materials or alloys that fit with constraints of the connector functions such as to be connected to an antenna, to be able to fix a cable, and other advantages of this kind of materials or alloys.

Preferably, the solder material has improved properties at temperatures greater than 150° C. Such a solder material is known from DE102006047764A1. Such a lead-free solder material is based on a solder alloy of Sn, Ag, comprising between 88% and 98.5% Sn by weight, between 0.5 and 5% Ag by weight or Bismuth-Tin-Silver (Bi—Sn—Ag) alloys. Preferably, the soldering material comprises the following alloys, at least as components thereof BixSnyAgz where x, y, z represents the percentage by weight of the component (this nomenclature is well-known): Bi57Sn42Ag0, Bi57Sn40Ag3, SnAg3.8Cu0.7, Sn55Bi44Ag1, or SAC alloys (Tin-Silver-Copper (Sn—Ag—Cu) alloys). More preferably, the solder alloy is a SAC305, consisting of 3% Ag by weight, 0.5% Cu by weight and 96.5% Sn by weight. This solder material offers improved bonding properties for the connectors used therewith, as well as high fatigue strength.

According to the invention, the connector element preferably is made of an iron-nickel (FeNi) or iron-chromium (FeCr) alloys, or a mixture thereof. More preferably, the connector element is preferably made of FeCr10, FeCr16, a Grade 430, FeNi42, FeNi48 or FeNi52.

Due to the high frequency used, the connection between the antenna and the cable has to be very precise to limit the distortion of the signal. In order to fulfill this condition, the connector comprises at least two mechanical fixing elements. These mechanical fixing elements allow maintaining the cable in the right place avoiding movements of the cable and ensure having a good electrical connection to the antenna. These elements may have a different composition than the connector. Preferably, the shield is connected to the antenna via at least one of the mechanical fixing element to have a very good electrical connection to the antenna.

According to the invention, the central pin is preferably connected to the antenna by a lead-free soldering separately from the electrically conductive connector. The central pin may be preferably crimped into an intermediate conductive element. In this case, the lead-free solder material is provided between the intermediate element and the antenna.

According to one embodiment of the invention, the electrically conductive connector preferably comprises at least an extended region for fixing mechanical fixing elements and at least one foot connected to the extended region for joining to the antenna by a lead-free solder material Those two parts meaning at least one foot and an extended region allow to facilitate the soldering of the connector to the antenna and the fixing of the cable. According to the invention, the extended region is the region that is not directly in contact with the antenna but electrically connected to the antenna through the foot. Preferably, the shape of the extended region may be a rectangular part, curved or not, or any other shapes. The foot is in contact with the antenna through the solder material. Preferably, the electrically conductive connector comprises at least one foot with a rounded shape. It is understood that the rounded shape term means any form with a general rounded shape like, in a non-limiting manner, an oval shape, an ovoid shape, an circle shape, a semi-circle shape, a clover shape, a multi-circles shape, a polyhedron like for example a part of a circle with cut edges, or a rectangular shape with rounded edges, like a rectangular with rounded corners. It could also be a single ring shape.

More preferably, the electrically conductive connector comprises two feet to have stability during the process of mounting the connector on the antenna and to stabilize the cable during the life-time of the glazing panel by avoiding any movement of the cable.

According to the invention, the electrically conductive connector comprises at least a part of the extended region provided between feet. When an at least a part of the extended region provided between feet, the shape of the extended region is a U-shape or a T-shape. A U-shape means a kind of bridge connecting the two feet. A T-shape means a kind of a bridge with a substantially perpendicular portion. The advantage of this kind of shapes is to have a symmetrical connector with a high stability.

According to the invention, mechanical fixing elements are provided to maintain the cable to the connector. They are preferably fixed to the extended region. Preferably, mechanical fixing elements are crimping elements to crimp the cable to the connector in order to reduce the process timing and avoid movement of the cable after the crimping step.

Preferably, mechanical fixing elements have the same composition than the extended region and may have been manufactured in the same piece than the extended region.

More preferably, to avoid deformation of the extended region due to the mechanical fixing of the cable, mechanical fixing elements are fixed to at least one edge of the extended region of the electrically conductive connector.

More preferably, to eliminate any fluctuation of behavior due to unstable coaxial cable connection with the extended region, mechanical fixing elements are fixed to opposite edge of the extended region of the electrically conductive connector.

In one embodiment of the present invention, the electrically conductive connector comprises three mechanical fixing elements; two of the mechanical fixing elements are electrically connected to the shield of the coaxial cable and are fixed to opposite edge of the extended region of the electrically conductive connector and one of the mechanical fixing elements is fixed to the insulated layer of the coaxial. This feature allows to ensure the electrical connectivity and to eliminate any fluctuation of behavior due to unstable coaxial cable connection with the extended region.

The present invention relates also to a connector comprising at least two mechanical fixing elements for maintaining the coaxial cable to the electrically conductive connector.

According to the invention, the connector preferably comprises at least an extended region for fixing mechanical fixing elements and one foot connected to the extended region for joining to the antenna by a lead-free solder.

According to the invention, the connector preferably comprises two feet.

According to the invention, the connector preferably comprises mechanical fixing elements which are fixed to at least one edge of the extended region of the electrically conductive connector.

According to another embodiment of the present invention, the vehicle or the building provided with an assembly comprising an antenna according to the present invention may be equipped with a repeater system. A repeater system typically comprises: an antenna positioned outside of the building or the vehicle, that can communicate with a base station of the network, an antenna positioned inside of the building or the vehicle, that can communicate with a user terminal, retransmission means provided to act as the interface between the antenna, by retransmitting (with the possibility of amplifying and regenerating) the signals received by one of the antenna destined for the other antenna. It may be understood that such a repeater system permits the network cover to be extended to the inside of the building or the vehicle, so that the users inside of the building or the vehicle may have a good network cover. A repeater system for relaying the exchanges between a base station of a mobile telecommunication network and a user terminal, comprises an outside antenna that can communicate with the base station, as well as retransmission means connected to the outside antenna, wherein the retransmission means are designed to act as the interface between the outside antenna and an inside antenna that can communicate with the user terminal to retransmit the signals received by one of the antennas destined for the other antenna.

The antenna is a high frequency multiband antenna. Just by way of an example, which should not limit the scope of the present invention, be it known that applicant designed an antenna, of the above described shape, with the three following frequency bands:

B1: 690 MHz-960 MHz
B2: 1710 MHz-2170 MHz
B3: 2500 MHz-2700 MHz.

The invention claimed is:

1. A two bidimensional part multiband antenna, comprising:

a first part of the antenna; and a second part of the antenna, the first and second parts of the antenna configured to be connected, respectively, to a central pin and a shield of a data transmission coaxial cable, wherein the first and second parts have a generally rectangular shape and are relatively to each other longitudinally shifted, a side of the first part facing the second part comprises a large transverse recess and a side of the second part facing the first part includes a corresponding transverse projection facing the large transverse recess and, the second part comprising the projection comprises, adjacent thereto, a thin longitudinal arm facing a short transversal finger of the first part comprising the recess and adjacent thereto.

2. The antenna of claim 1, wherein the first part of the antenna provided with the recess and its adjacent transversal finger, comprises, on another side of the large recess and along the longitudinal side of said first part facing the second part with the projection, two transversal and narrow recesses on both sides of a narrow tooth.

3. The antenna of claim 1, wherein the first part of the antenna, provided with the transversal finger, comprises, on a transversal side opposite thereto, a large longitudinal recess.

4. The antenna of claim 1, wherein the first and second parts of the antenna comprise holes for saving material without altering the electrical function of the antenna.

5. A glazing panel comprising a transparent sheet with the antenna of claim 1 printed thereon.

6. The glazing panel of claim 5, wherein the transparent sheet is a sheet of glass.

7. The glazing panel of claim 5, wherein the glazing panel is an automotive glazing.

8. The glazing panel of claim 7, wherein the glazing panel is a backlite, a sidelite or a windshield panel.

9. The glazing panel of claim 5, wherein the transparent sheet is a sheet of plastics.

10. The antenna of claim 1, wherein the transverse projection projects into the lame transverse recess.

11. A two bidimensional part multiband antenna, comprising:

a first antenna part; and a second antenna part, wherein the first and second parts have a generally rectangular shape and are longitudinally shifted relative to each other, a side of the first part facing the second part comprises a transverse recess and a side of the second part facing the first part includes a corresponding transverse projection facing the transverse recess, the transverse projection having a width narrower than a width of the transverse recess, and the second part comprises, adjacent to the transverse projection, a longitudinal arm perpendicular to and facing a transverse finger of the first part and adjacent thereto.

12. The antenna of claim 1, wherein the first part of the antenna, provided with the transversal finger, comprises, on a transversal side opposite thereto, a longitudinal recess.

13. The antenna of claim 1, wherein the first and second parts of the antenna comprise holes for saving material without altering an electrical function of the antenna.

14. A glazing panel comprising a transparent sheet with the antenna of claim 11 printed thereon.

15. The glazing panel of claim 14, wherein the transparent sheet is a sheet of glass.

16. The glazing panel of claim 15, wherein the glazing panel is an automotive glazing.

17. The glazing panel of claim 16, wherein the glazing panel is a backlite, a sidelite or a windshield panel.

18. The glazing panel of claim 14, wherein the transparent sheet is a sheet of plastics.

19. The antenna of claim 11, wherein the transverse projection projects into the transverse recess.

* * * * *